US008938817B1

(12) United States Patent
Baldi

(10) Patent No.: US 8,938,817 B1
(45) Date of Patent: Jan. 27, 2015

(54) EXTERNAL HELMET CUSHIONING SYSTEM

(71) Applicant: Apalone, Inc., Peoria, IL (US)

(72) Inventor: Steven T. Baldi, Peoria, IL (US)

(73) Assignee: Apalone, Inc., Peoria, IL (US)

( * ) Notice: Subject to any disclaimer, the term of this patent is extended or adjusted under 35 U.S.C. 154(b) by 0 days.

(21) Appl. No.: 14/202,891

(22) Filed: Mar. 10, 2014

Related U.S. Application Data

(60) Provisional application No. 61/776,145, filed on Mar. 11, 2013.

(51) Int. Cl.
*A42B 3/00* (2006.01)
*A42B 3/12* (2006.01)

(52) U.S. Cl.
CPC ..... *A42B 3/12* (2013.01)
USPC ..... 2/411

(58) Field of Classification Search
USPC ..... 2/410, 411, 412, 413, 414, 416, 421, 2/425, 5, 6.1, 6.2, 7, 468
See application file for complete search history.

(56) References Cited

U.S. PATENT DOCUMENTS

| | | | | |
|---|---|---|---|---|
| 5,887,289 | A * | 3/1999 | Theoret | 2/425 |
| 6,446,270 | B1 * | 9/2002 | Durr | 2/412 |
| 7,089,602 | B2 * | 8/2006 | Talluri | 2/411 |
| 8,196,226 | B1 * | 6/2012 | Schuh | 2/412 |
| 8,533,869 | B1 * | 9/2013 | Capuano | 2/411 |
| 8,640,267 | B1 * | 2/2014 | Cohen | 2/411 |

* cited by examiner

*Primary Examiner* — Tejash Patel
(74) *Attorney, Agent, or Firm* — Husch Blackwell LLP

(57) ABSTRACT

An external cushioning system for a helmet includes an outer shell disposed outwardly of an outer surface of a helmet; an absorptive layer between the outer shell and the outer surface of a helmet; and an attachment mechanism to couple the external cushioning system to the helmet. The system may also include at least one cushion strategically positioned to absorb impact forces.

27 Claims, 6 Drawing Sheets

EXTERNAL HELMET CUSHIONING SYSTEM

CROSS-REFERENCE TO RELATED APPLICATION

This application claims the benefit of U.S. Provisional Patent Application No. 61/776,145, filed Mar. 11, 2013, the entire disclosure of which is hereby incorporated by reference.

FIELD OF THE INVENTION

This present invention relates to an external helmet cushioning system that can be applied over any existing helmet or incorporated into a newly manufactured helmet; in particular, helmets for high-impact sports such as football, hockey, lacrosse, snow sports, or any other sport that uses a helmet.

BACKGROUND OF THE INVENTION

The life-long effects of one or more concussions experienced by participants in sports and other activities are becoming an alarming realization. Many high-school, college, and professional football players have recently experienced debilitating effects of multiple concussions and even effects of repeated impacts to the head without a concussion on mental capacity and cognition. With the continual impacts associated in football, hockey and lacrosse, the trends of brain damage associated with impact-heavy sports will undoubtedly continue. However, despite these trends, it does not appear that society is ready to slow the participation rates in these sports. In many of these sports, participation begins with children as young as six-years old with a large number continuing through high-school, and some continuing to play into college and the professional ranks. As such, there is a great need in the art for a helmet cushioning system that can decrease the effects of the regular impacts inherent in these activities and decrease the incidents of concussions experienced by active participants.

Moreover, multiples studies conclude that the occurrence of head trauma cannot be related to make, model, or the age of the helmet, which is likely due to the fundamental similarity of all helmets currently manufactured. Accordingly, there is a further need in the art for a helmet cushioning system that can be retro-fitted to most, if not all, popular brands of existing helmets to make the system economically feasible for all participants. There is a further need for a helmet cushioning system that reduces the soft tissue injuries of other participants due to impact against a helmet.

BRIEF SUMMARY OF THE INVENTION

An aspect of the invention generally pertains to a helmet cushioning system that can decrease the effects of the regular impacts inherent to these activities and decrease the incidents of concussions experienced by active participants.

Another aspect of the invention generally pertains to a helmet cushioning system that can be retro-fitted to most, if not all, popular brands of existing helmets to make the system economically feasible for all participants.

Yet another aspect of the invention generally pertains to a helmet cushioning system that reduces the soft tissue injuries of other participants due to impact against a helmet. The external cushioning system for an existing or new helmet may comprise a first shell having an outer surface, a second shell outward of the outer surface of the first shell an offset distance, an absorptive layer disposed between the outer surface of the first shell and the second shell, and an attachment mechanism to couple the second shell to the first shell. The second shell may be permanently or temporarily coupled to the first shell. The second shell may be outward of the first shell by an offset distance of between 1/16 inch to 2 inches, and in another embodiment, the offset distance may be around one-half inch. The second shell may have a portion which is removable and replaceable with respect to the first shell. The first shell may be rigid, semi-rigid, or flexible. The second shell may be rigid, semi-rigid, or flexible. In the event the second shell is rigid, it may have a thickness which fractures upon application of a particular force, the particular force maybe less than or equal to a pre-determined threshold force at which a user should undergo further evaluation.

The external cushioning system may include the absorptive layer comprising a uniform thickness, or alternatively different thicknesses at different areas of the shell, for example at a top of the second shell and a side of the second shell. The external cushioning system may also include one or more cushions strategically positioned at one of a forehead portion and a rear portion of the second shell to absorb impact forces. The cushion may be located underneath the second shell or it may be coupled to the second shell, wherein the cushion may include a cover layer and a thickness of absorptive material. The one or more cushions may be strategically positioned at one of a forehead portion and a rear portion of the second shell to absorb impact forces. The cushion may be customizable to one of the level of play and the size of the player.

These aspects are merely illustrative of the innumerable aspects associated with the present invention and should not be deemed as limiting in any manner. These and other aspects, features and advantages of the present invention will become apparent from the following detailed description when taken in conjunction with the referenced drawings.

BRIEF DESCRIPTION OF THE DRAWINGS

The accompanying drawings form a part of the specification and are to be read in conjunction therewith, in which like reference numerals are employed to indicate like or similar parts in the various views.

DETAILED DESCRIPTION

The following detailed description of the present invention references the accompanying drawing figures that illustrate specific embodiments in which the invention can be practiced. The embodiments are intended to describe aspects of the present invention in sufficient detail to enable those skilled in the art to practice the invention. Other embodiments can be utilized and changes can be made without departing from the spirit and scope of the present invention. The present invention is defined by the appended claims and, therefore, the description is not to be taken in a limiting sense and shall not limit the scope of equivalents to which such claims are entitled.

Figure 1:
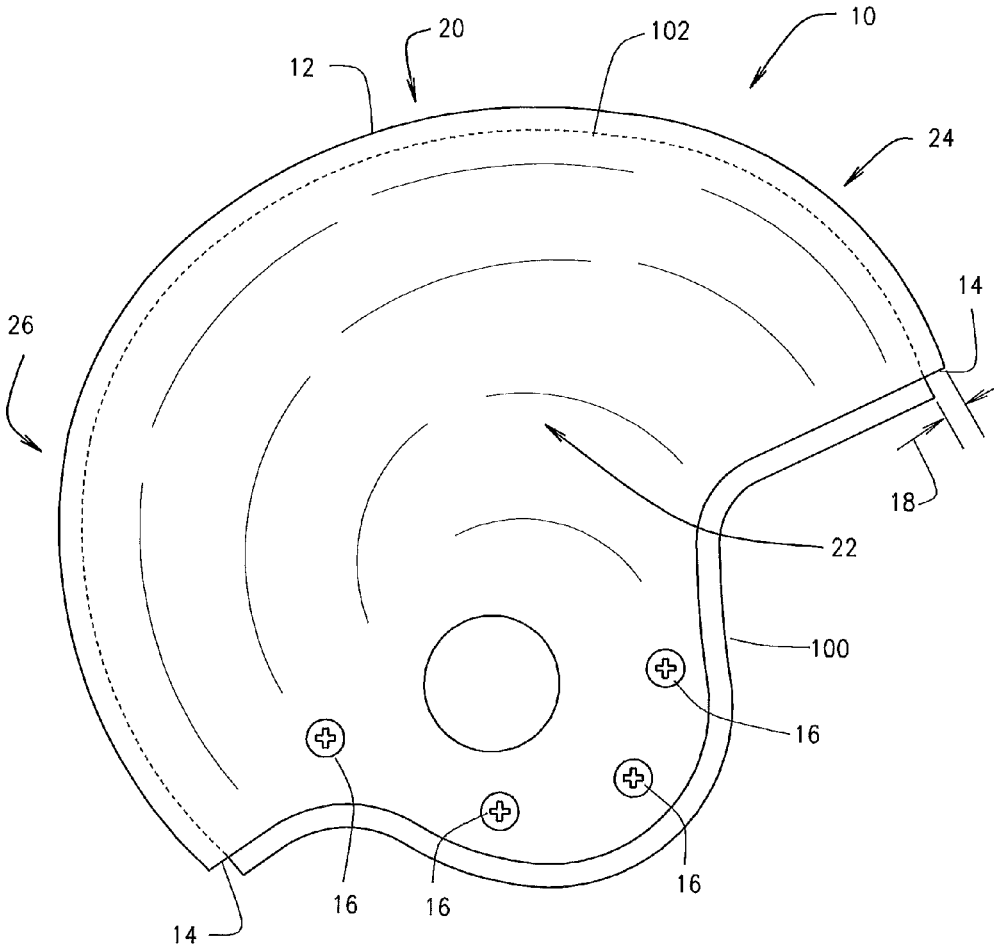
FIG. 1 is a side view of one embodiment of an external helmet cushioning system in accordance with the teachings of the present disclosure.

As shown in FIG. 1, the present external helmet cushioning system 10 includes a shell 12, an absorptive layer 14, and at least one attachment member 16 to couple the system to an existing helmet 100. The attachment mechanisms 16 may removeably couple the system to the helmet 100. As shown, the shell 12 is the outermost layer and the absorptive layer 14 is generally disposed between the shell 12 and the outer surface 102 of existing helmet 100. It is widely accepted that concussions and head trauma are related to both linear and rotational forces due to in the impact. However, there is some debate as to which of these is more significant. As such, embodiments of the present external helmet cushioning system may be designed to reduce an offset distance 18, the increase in thickness of the helmet due to the added cushioning. Offset distance 18 may be any distance, with a preferably range from around one-sixteenth (1/16) to around two (2) inches. However, one embodiment of the present external helmet cushioning system 10 consciously balances the thickness of the absorptive layer 14 for direct cushioning due to straight-line linear impact, and keeping the offset distance 18 minimized to reduce the possible moment arm of the applied force to help minimize rotational acceleration due to the applied force. The shell 12 has a top 20, a side 22, a front 24, and a rear 26.

Throughout the entire disclosure, the shell 12 may be a flexible material, a semi-rigid material, or a rigid material. A flexible shell 12 will be easily displaced and acts more as a membrane to distribute the applied force to the absorptive layer 14 and cushions. The flexible shell 12 may have sufficient elasticity such that it returns to its original shape when deformed upon impact. The distribution of force applied to the absorptive material 14 under a flexible shell 12 will be more locally realized.

However, a rigid shell 12 will generally exhibit little to no deformation upon an impact and, therefore, will not be as resilient upon the application of a large force. Because there the entire shell 12 will be displaced upon impact, a greater area of the absorptive layer 14 will be compressed and the rigid shell 12 can more broadly dissipate larger forces. This may allow for the use of a thinner absorptive layer 14 thereby reducing off-set distance 18. The rigidity and stiffness of the rigid shell 12 may result in a fracture upon the application of at a certain force or acceleration requiring the replacement of the present external helmet cushioning system 10. The fracture of the a rigid shell 12 of the present external helmet cushioning system 10 at a given impact force may be designed into the shell 12 to provide additional energy dissipation of impact forces exceeding a predetermined value, or alternatively, the fracture force for a rigid shell 12 may be designed to an indicator of when a participant has experienced a force of a predefined and/or threshold value (such as 90% the minimum acceleration known to cause brain injury). The fracture may provide a visual signal that the participant's activity should be reduced or stopped, or may indicate that the participant should be more closely monitored or observed for a brain injury or otherwise evaluated. A semi-rigid shell 12 includes elements of both flexibility and rigidity in that for most impacts, the semi-rigid shell 12 will distribute the impact to a larger area of the absorptive layer 14 than a flexible shell 12; however, upon the application of larger impact point forces, the semi-rigid shell 12 may deflect without fracture and return to its original shape.

The shell 12 may be any material having the desired physical properties. Embodiments of the shell 12 may be made from polymers, plastics, thermoplastics, PVC, vinyl, nylon, or other similar material. The shell 12 may be comprised of a material having a smooth outer surface and a high level of mar-resistance. These properties may reduce the drag coefficient that occurs between two helmets when they collide, or between the shell and the surrounding air, which helps reduce rotational forces generated through friction that may cause trauma and influence the probability of a neck injury. For purposes of this disclosure, shell 12 may be considered a second shell and the shell of the existing helmet may be considered a first shell.

The absorptive material layer 14 may be any known elastic or viscoelastic material such as gels, open-cell foam, closed-cell foam, vinyl nitrile, styrofoam, rubber, neoprene, foamed polymers, polyurethane foam, latex foam, micro-cellular urethane foam (MCUF) or a viscoelastic foam, or any other elastic or viscoelastic material having a force absorbing spring-like response. The absorptive material layer 14 may be a material that can undergo a large elastic deformation in a quick time period and has a rather slow elastic response, but will eventually return to its original shape.

Figure 2:
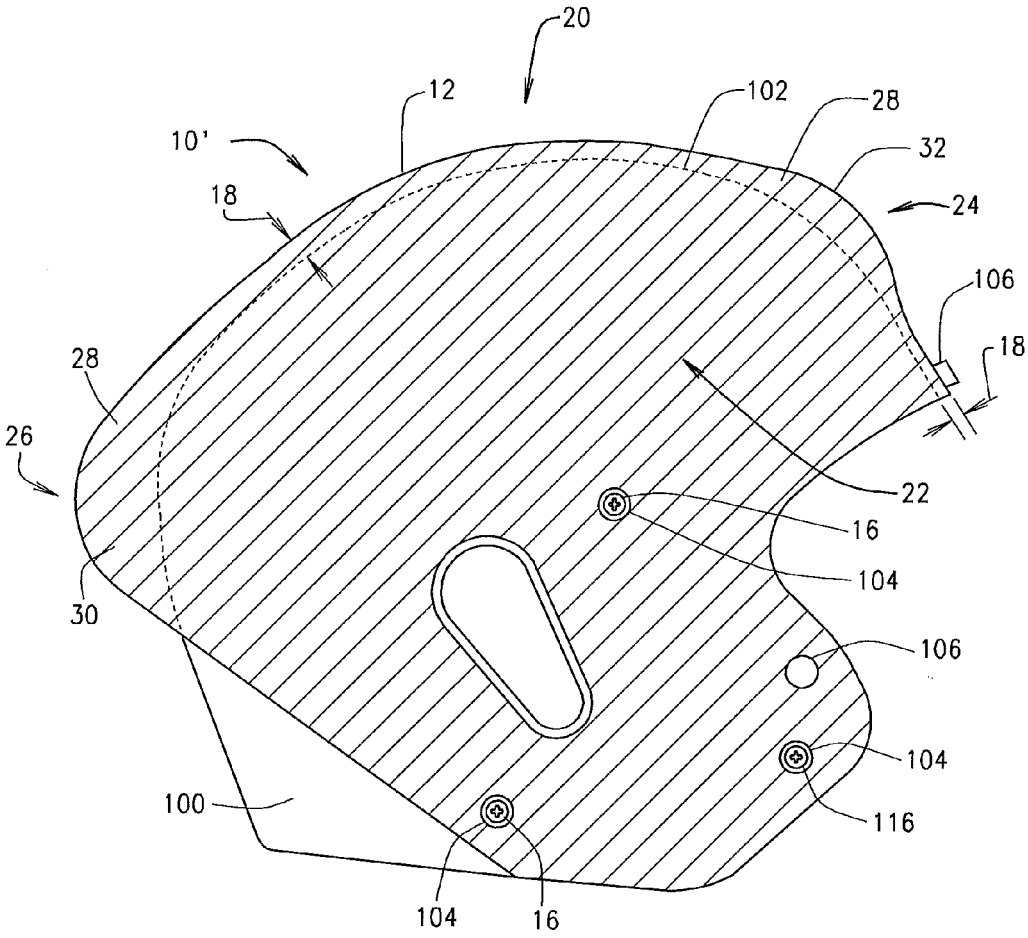
FIG. 2 is a side view of another embodiment of an external helmet cushioning system in accordance with the teachings of the present disclosure.

FIG. 2 illustrates one embodiment of the external helmet cushioning system 10' installed over an existing helmet 100. The outer shell 12 of the external helmet cushioning system 10' is shown substantially covering the entire existing helmet 100. Accordingly, the shell 12 of the present external helmet cushioning system 10' may be molded or otherwise manufactured into a shape that fits any currently manufactured helmet 100. As shown in FIG. 2, the attachment member 16 for this embodiment is the chin-strap snaps 104 of the helmet 100. The chin-strap snaps 104 may be removable in existing helmets 100 and, thus, the external helmet cushioning system 10' may be installed over a helmet 100 with the chin-strap snaps 104 removed. When the chin-strap snaps 104 are re-secured to the helmet 100, it clamps the external helmet cushioning system 10 against the helmet 100. The face-mask mounts 106 of the existing helmet 100 may also be similarly used to secure the external helmet cushioning system 10'. A similar mounting method may be incorporated into all of the present embodiments.

Figure 3:
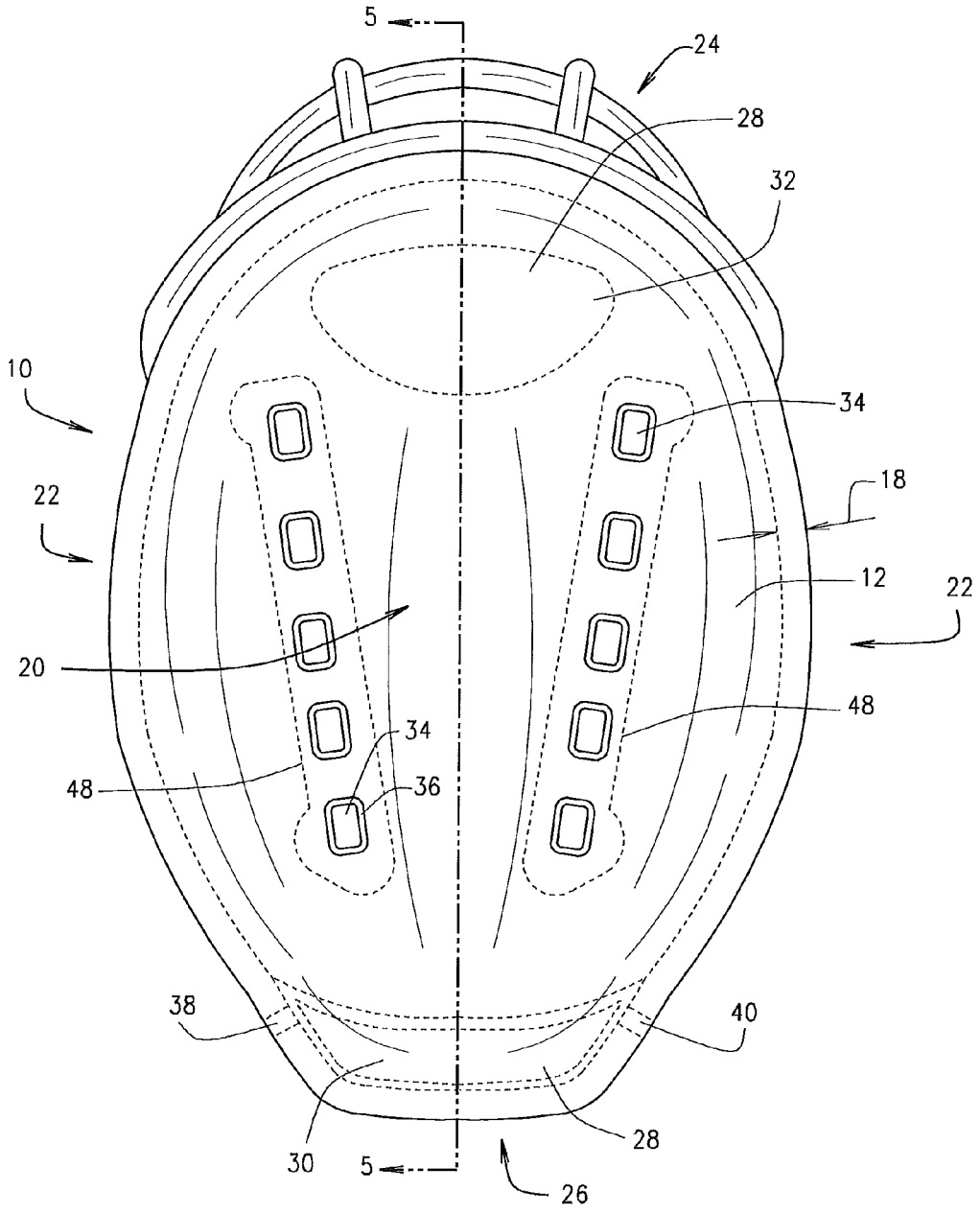
FIG. 3 is a top view of the external helmet cushioning system of FIG. 2.

One embodiment of external helmet cushioning system 10 may also include one or more cushions 28 disposed between the shell 12 and the outer surface 102 of the existing helmet 100 wherein the cushions 28 are positioned at strategic locations to reduce the force of impact delivered to a person's head. FIG. 2 also illustrates protrusions in the external helmet cushioning system 10' which house the cushions 20. FIG. 2 illustrates an embodiment wherein the cushions 28 are underneath the shell 12. FIG. 3 illustrates a top view of an embodiment of external helmet cushioning system 10' wherein the shell 12 is separated from the existing helmet by the absorptive layer 14. FIG. 3 shows the placement of a forehead cushion 32 proximate the front 24 and a rear cushion 30 proximate the rear 26 of shell 12. In this embodiment, the rear cushion 30 may be an air baffle cushion shown in FIGS. 3 and 4 that displaces air through a first vent 38 and a second vent 40 when the rear cushion 30 is compressed, such as when the back of a player's head impacts the ground.

Figure 4:
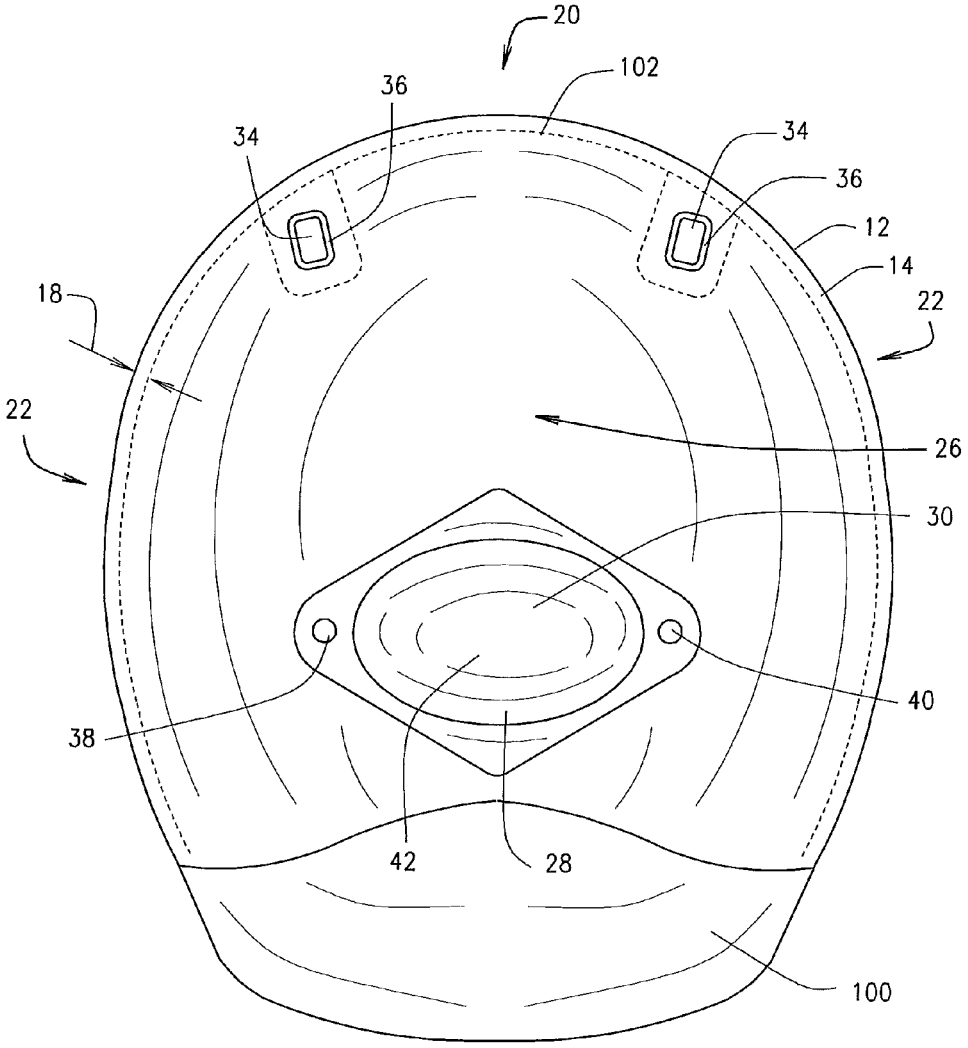
FIG. 4 is a rear view of the external helmet cushioning system of FIG. 2.

FIG. 4 shows the rear cushion 30 and vents 38 and 40 through the shell 12 and the absorptive material 14. This configuration reduces the overall offset of the present cushioning system, and strategically places cushions at locations where the greatest impacts occur, such as the back of the head, from the head being thrown backward and the fore head due to direct frontal contact such as is often common in football. However, one feature of this system is that the cushions may be strategically placed for injuries seen in each individual sport. For example, cushions 28 may be placed in different locations in football helmets than in hockey or lacrosse helmets.

Figure 5:
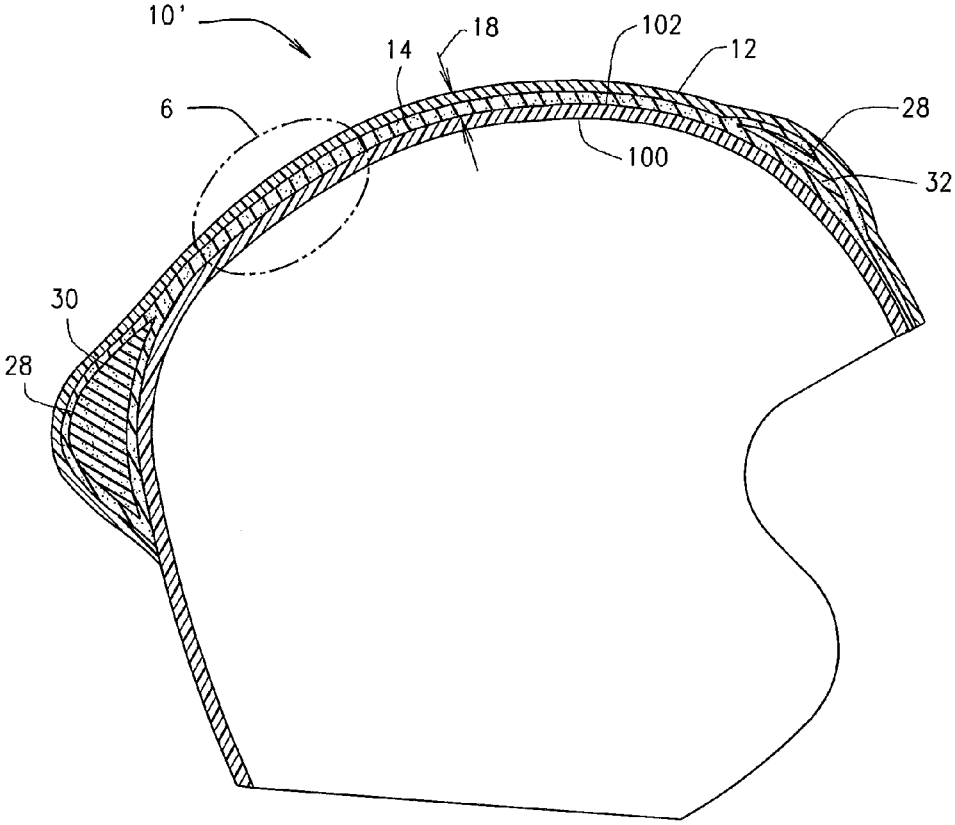
FIG. 5 is a section view of the external helmet cushioning system of FIG. 3 cut along the line 5-5.
Figure 6:
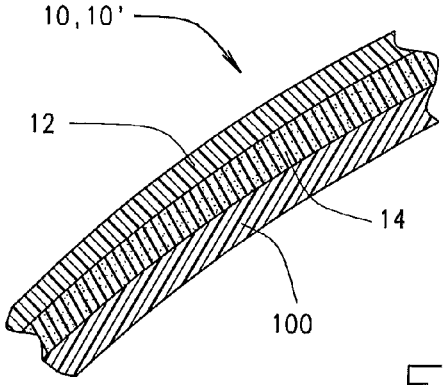
FIG. 6 is a blow up view of the external helmet cushioning system of FIG. 5.

FIG. 5 is a cross-section through the helmet and the present external helmet cushioning system of FIG. 2 showing the positioning of forehead cushion 32 and rear cushion 30. FIGS. 5 and 6 illustrate a preferred embodiment of the present external helmet cushioning system 10 wherein the absorptive layer 14 is sandwiched between and contacts the outer surface 102 of an existing helmet 100 and the shell 12 of the external helmet cushioning system 10'.

The cushions 28 may be an elastic or viscoelastic, and may be any known foam, air baffle, gel, vinyl nitrile, or other compressible material identified above as an absorptive material or otherwise similar thereto that may be strategically placed in the present external helmet cushioning system in addition to the absorptive layer. The principle function of the cushions 28 are to dampen the force generated to the head and neck when an individual is forced to the ground or impacted by an outside object, such as another helmet. A preferred embodiment of a cushion 28 is a baffle cushion system. A baffle cushion is held in place with a tight fit at its upper and lower aspects with gaps existing in the alter aspects between the end of the chamber and the end of the cushion. The gaps provide channels for air to be expelled through air vents upon compression of the cushion and for air to be drawn back into the cushion when elastically returning to its original shape.

The cushions 28 having different materials, densities, thickness, or sizes may be implemented into the external helmet cushioning system based upon the size of the player (height and weight) and/or the level of play, i.e., elementary, junior high, high school, college, or professional. The cushioning system may be configured to allow the cushion 28 to be easily removed and replaced if it is worn out or needs to be changed due to a change in the player's size or the level of play.

The baffle or similar construction is preferred because upon a large impact, if the baffle becomes fully compressed and at its force absorbing limit, the user retains the full cushioning inside the helmet. This is an advantage over current systems as a majority of the force is already dissipated through the cushion prior to a player's head engaging the interior cushioning of the existing helmet. This feature is particularly effective when a player's head snaps backward against the ground and there can be substantial angular acceleration and force generated. The shape of a rear cushion 30 may be configured having angular shape as shown in FIGS. 2, 3-5 so that external force applied to the rear cushion 30 may be deflected and additional rotation caused by the force can be minimized or eliminated. Another strategic location for a cushion 28 is the forehead cushion 32 shown in FIGS. 2-5 and 7 which can be positioned to help absorb front facing helmet to helmet contact frequently experience during a contact sport, particularly by opposing linemen in football.

One embodiment shown in FIG. 5 includes a shell 12 made from a semi-rigid material. For example, a material similar in material properties as plastic car bumpers. The semi-rigid shell 12 may include holes (not shown) that allow a user to access the air valves to adjust the interior cushioning of the helmet. These access holes will align with the air valves of a particular helmet 100 and may also be provided in flexible and rigid shells 12. In one embodiment shown in FIG. 7, the semi-rigid shell 12 extends over the cushions 28 as shown in FIG. 5. In another embodiment, the semi-rigid or rigid shell 12 includes a cushion 28 having a cover 42 that is fabric or other flexible material that may be permanently or removeably coupled to the exterior surface of the semi-rigid shell so that the cushion may fully compress. The semi-rigid shell may not have sufficient flexibility to allow for full compression of the rear cushion 30. As shown in FIG. 4, the rear cushion 30 is configured to vent air through openings first vent hole 38 and second vent hole 40, although, a vent may be positioned at any location proximate the cushion. The rear cushion 30 may have a cover 42 that is fabric (see FIG. 7) or a flexible or semi-flexible shell 12 (see FIG. 5). In another embodiment, if a forehead cushion 32 is incorporated into a semi-rigid shell 12, it may have a cover 44 that is fabric (shown in FIG. 7) if the shell is more-rigid, or forehead cushion 32 may be covered by the semi-rigid shell (shown in FIG. 5) as the semi-rigid shell may provide sufficient flexure to displace and utilized the full capacity of the forehead cushion 32.

Shell 12 may also incorporate a slot 48 (shown in broken lines in FIG. 3) in place of the top vents 34 for venting along the top 20 and/or side 22 of the helmet 100. Further, at top vent openings 34, the opening may terminate in a bevel 36 wherein the bevel 36 allows compression of the shell and also acts as a barrier to keep the absorptive layer 14 dry. An embodiment of semi-rigid shell 12 may include an attachment member 16. Again, one embodiment of the attachment members 16 utilizes the chin-strap snaps 104 and/or face-mask mount 106 to secure the present external helmet cushioning system 10 or 10' to the helmet 100 and the attachment member 16 may wrap the edge of the helmet 100.

Figure 7:
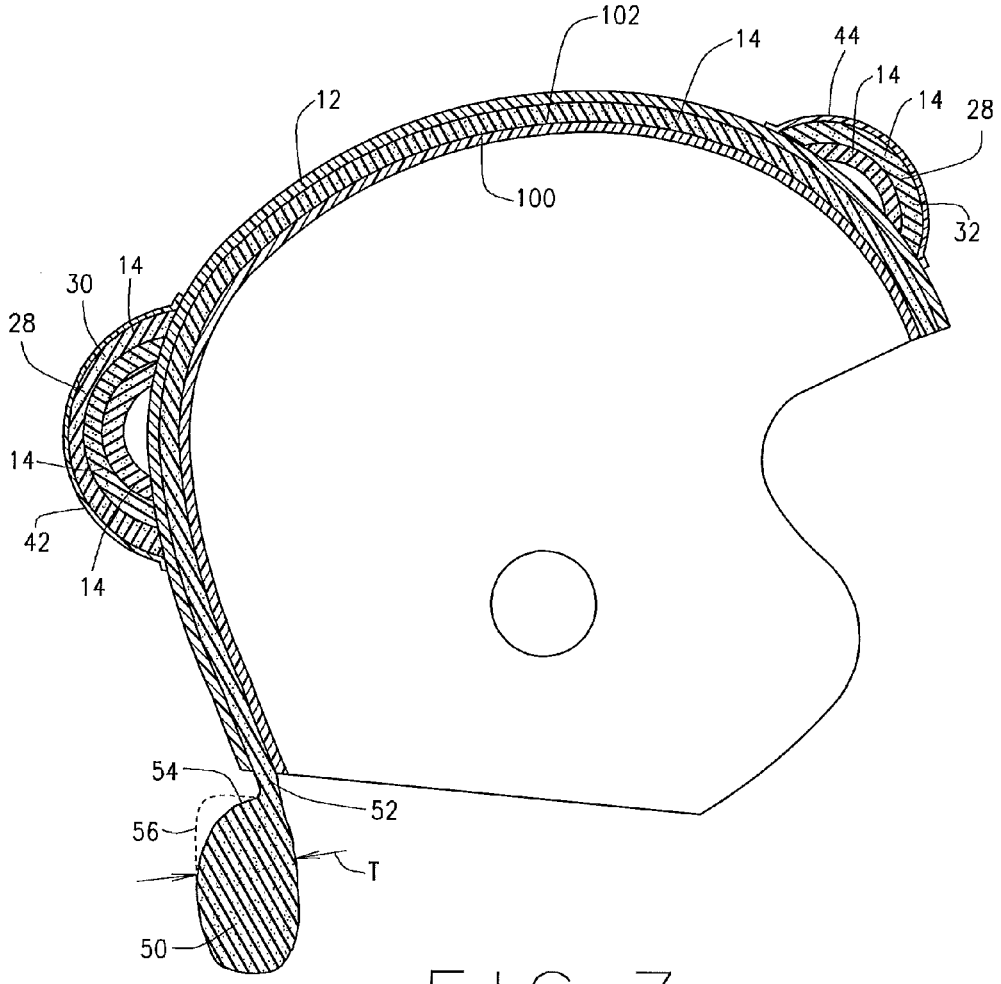
FIG. 7 is a section view of an alternative embodiment of the external helmet conditioning system cut along the same line as FIG. 5.

FIG. 6 shows an enlargement of a section of showing the absorptive layer 14 disposed between shell 12 and an outside surface 102 of helmet 100. This section is representative of the basic design that can be used with or without extra cushions (See FIGS. 2-5 and 7). As shown in FIG. 7, the shell 12 may be a rigid shell. The rigid shell 12 may be provided as a single piece that is attached to helmet 100 that attaches to the chin-strap snaps 104 (See FIG. 2). The rigid shell 12 may be similar to a standard helmet shell currently in use. The absorptive layer 14 disposed between shell 12 and outer surface 102 of helmet 100. The thickness or density of the absorptive layer 14 may be varied at different positions such as the top 20 and side 22 depending upon the type of impact commonly occurring at each location and material used in the absorptive layer 14. As further shown rear cushion 30 may include a cover 42 of fabric or other flexible or semi-flexible material and one or more layers of absorptive material 14 as shown. However, one shaped piece of absorptive material may be used. Similarly, forehead cushion 32 may similarly include a cover 42 of fabric or other flexible or semi-flexible material and one or more layers of absorptive material 14 as shown. Rear cushion 30 and forehead cushion 32 may be coupled to rigid shell using any method known in the art, such as adhesives, mechanical fasteners, or any other coupling material. When incorporated into a rigid shell 12, the rear cushion 30 and forehead cushion 32 may both be external to the shell, having a cover 42 or 44 of fabric or other flexible material, and vented out of the rigid shell through vents 38 and 40, or the fabric or other flexible material, so as to provide sufficient compression capacity to obtain the full benefit of the cushioning system 10.

In an alternative embodiment not shown, the rigid shell may be comprised of two parts, an upper part and a lower part. The upper part includes an absorptive layer or cushioning layer which engages the existing helmet. The lower part may also be called the attachment portion as the lower part attaches to the helmet, for example using the chin-strap snaps 104 in a similar configuration as described above. The lower part and the upper part may be joined at a seam. The seam may be comprised of each part having complimentary and interlocking U-shaped portions that allow for relative linear motion, but generally resist a transverse motion that would separate the upper shell from the lower shell. One leg of each U-shaped portion is positioned in the recess between the legs of the other U-shaped portion and when the leg of the U-shaped portion of the upper part is displaced downward a sufficient distance, then the seam may be separated and the upper part may be separated from the lower part. This is convenient for installing and removing the rigid shell embodiment of the present external helmet cushioning system and/or replacing fractured shells when the fracture indicator option described above is incorporated therein.

FIG. 7 also includes an embodiment of a neck support extension 50 of absorptive layer 14 or that could be alternatively configured or coupled to shell 12 (not shown). Neck support extension 50 is provided to reduce the acceleration of the head in a backward direction. As such, when neck flexure increases, the neck support extension's 50 inherent resistance to rotation in the leg portion 52 provides some resistance to sudden backward or sideways rotational forces. However, once a specific degree of flexure occurs, the safety ridge 54 engages the back of the helmet and an increased cushioning affect and movement absorption is provided by the desired thickness T of neck support extension 50. As shown in FIG. 7 by a broken line, a higher safety ridge 56 can be provided to engage the helmet sooner to reduce the amount of rotation experienced before the increased resistance occurs. This allows for personalization of the pad based upon individual needs. Thus, neck support extension 50 is provided such that a defined amount of rotation of the head is resisted with less cushioning, but once a pre-determined amount of rotation occurs, an increased force absorption, deceleration and cushioning is provided.

While the above embodiments are described in relation to an external helmet cushioning system that can be retrofit onto an existing helmet of any brand, the above features of the external helmet cushioning system may be incorporated into a newly manufactured helmet including the specifically configured attachment mechanisms and other considerations to improve the cushioning performance and impact resistance of a helmet. In a new helmet, one variation which may provide substantial improvements in performance includes a inner or first shell (replacing the exterior shell of an existing helmet) being flexible or semi-rigid and the outer or second shell 12 being rigid with the absorptive layer 14 disposed between.

The effectiveness of the above described external helmet cushioning systems 10 and 10' has been substantiated through research and testing. The modified helmets were subjected to standardized testing procedures to evaluate the effectiveness of each modification in reducing impact forces. Prior to testing all helmets were condition by bringing them to an ambient temperature of 76°. The absorptive material of the cushioning system used was micro-cellular urethane foam which varied in thickness and density in the two modified helmets. The additional offset 18 added to the helmet 100, i.e. the increased thickness of the helmet due the thickness of the cushioning system used was around one-half inch, which is considered minimal in the art.

The first helmet tested was an unaltered, stock football helmet and the test results are provided in Chart 1 below and is the control helmet. The second and third helmets were modified using two different embodiments of the external element cushioning system 10' providing cushioning at the different impact points.

The CSR helmet is similar to the embodiment of FIGS. 2, 3, 4 and 7 and includes a rigid outer shell similar to a standard hard-plastic football helmet shell, the absorptive layer 14 on top 20 is only an air cushion, the absorptive layer 14 disposed on side 22 is micro cellular urethane foam (MCUF), the forehead cushion 32 includes a flexible cover with open-cell foam, and the rear cushion 30 comprises the cover 42 of fabric covering a thickness of open-cell foam. The testing results of the CSR embodiment are presented in Chart 2 below.

The PSR helmet is similar to the embodiment of FIGS. 2, 3, 4 and 7 and includes a rigid outer shell 12 similar to a standard hard-plastic football helmet shell, the absorptive layer 14 on top 20 is with an air cushion, the absorptive layer 14 disposed on side 22 is MCUF, the forehead cushion 32 comprises a semi-rigid plastic covering a layer of MCUF, and the rear cushion 30 comprises the cover 42 of fabric covering an additional thickness of MCUF. The MCUF in the CSR and PSR embodiments were different thicknesses and densities. The testing results of the CSR embodiment is presented in Chart 3 below.

The fundamental objective of the testing was to evaluate whether the external cushioning system would perform as expected and the form in which it would work most efficiently. The results are presented below in the following charts.

CHART 1

| Control - Existing Football Helmet | | | | | | | | | | | | |
|---|---|---|---|---|---|---|---|---|---|---|---|---|
| Drop Velocity | Front | | | Side | | | Rear | | | Top | | |
| (ft/s) | SI | GS | Vel. | SI | GS | Vel. | SI | GS | Vel. | SI | GS | Vel. |
| 11.34 | 215 | 77 | 11.75 | 66 | 42 | 11.51 | 107 | 53 | 11.7 | 164 | 32 | 11.5 |
| 13.89 | 357 | 96 | 14.24 | 121 | 53 | 14.22 | | | | | | |
| 16.04 | 480 | 115 | 162.26 | 257 | 76 | 16.24 | | | | | | |
| 17.94 | 595 | 117 | 18.34 | 501 | 126 | 18.27 | 509 | 114 | 18.16 | 596 | 108 | 18.23 |
| 17.94 | 581 | 114 | 18.29 | 530 | 134 | 18.3 | 525 | 120 | 18.24 | 602 | 108 | 18.29 |

CHART 2

| CSR Helmet | | | | | | | | | | | | |
|---|---|---|---|---|---|---|---|---|---|---|---|---|
| Drop Velocity | Front | | | Side | | | Rear | | | Top | | |
| (ft/s) | SI | GS | Vel. | SI | GS | Vel. | SI | GS | Vel. | SI | GS | Vel. |
| 11.34 | 148 | 59 | 11.73 | 82 | 53 | 11.51 | 71 | 39 | 11.42 | 173 | 58 | 11.71 |
| 13.89 | 292 | 79 | 14.1 | 143 | 61 | 14.27 | | | | | | |
| 16.04 | 437 | 99 | 16.26 | 215 | 70 | 16.13 | | | | | | |
| 17.94 | 596 | 117 | 18.4 | 359 | 100 | 18.24 | 440 | 106 | 18.11 | 652 | 132 | 18.42 |
| 17.94 | 581 | 114 | 18.28 | 373 | 102 | 18.11 | 447 | 105 | 18.05 | 627 | 132 | 18.25 |

CHART 3

| PSR Helmet | | | | | | | | | | | | |
|---|---|---|---|---|---|---|---|---|---|---|---|---|
| Drop Velocity | Front | | | Side | | | Rear | | | Top | | |
| (ft/s) | SI | GS | Vel. | SI | GS | Vel. | SI | GS | Vel. | SI | GS | Vel. |
| 11.34 | 206 | 80 | 11.67 | 62 | 43 | 11.35 | 95 | 46 | 11.45 | 151 | 58 | 11.63 |
| 13.89 | 358 | 102 | 14.08 | 129 | 64 | 14.21 | | | | | | |
| 16.04 | 502 | 124 | 16.28 | 190 | 73 | 16.04 | | | | | | |
| 17.94 | 665 | 131 | 18.37 | 298 | 82 | 18.26 | 388 | 108 | 18.21 | 628 | 131 | 18.27 |
| 17.94 | 618 | 128 | 18.32 | 296 | 88 | 18.18 | 460 | 116 | 18.32 | 628 | 134 | 18.37 |

The principle result is the Severity Index (SI), GS (gravitational force), and velocity measured by the instruments. The "Severity Index" or "SI" is a measure of the severity of impact with respect to the instantaneous acceleration experienced by the head form as it is impacted. Acceptable Severity Index (SI) levels measured during impact cannot exceed the limit specified in the individual standard performance specification. The Severity Index is defined as:

$$SI = \int_0^T A^{2.5}\,dt$$

where A is the instantaneous resultant acceleration expressed as a multiple of g (acceleration of gravity); dt are the time increments in seconds; and the integration is carried out over the essential duration (T) of the acceleration pulse. For purposes of electronic data gathering, the integration as called for in this formula must begin after the system triggers but before the initial signal rises above 4 g's. The integration must then end when the signal falls below 4 g's, after it has peaked. In short, the greater the SI, the greater the impact's effect on a user's head and brain. Thus, the Severity Index is the most important take-away from the above results.

Summarizing the results above, and looking at the Severity Index for the helmets traveling at the greatest tested velocity (17.94 ft/s) yields the following results, the average SI for the control football helmet of Chart 1 is 588 for a front impact, 515.5 for a side impact, 517 for a rear impact and 599 for a top impact. The average SI for the CSR helmet of Chart 2 is 588.5 for a front impact (virtually no effect), 366 for a side impact (around a 30% decrease), 443.5 for a rear impact (around a 14% decrease) and 639.5 for a top impact (around a 7% increase). The average SI for the PSR football helmet of Chart 3 is 641.5 for a front impact (about a 9% increase over the control), 297 for a side impact (about a 42% decrease over the control), 424 for a rear impact (around an 18% decrease) and 628 for a top impact (about a 5% increase).

The side impact data is significant in that the additional offset 18 added to the helmet, the increased thickness of the helmet, was minimal. The above test data demonstrates that the offset 18 due to the present cushioning system 10 may be minimal thereby minimally increasing the overall weight of a helmet, but simultaneously significantly increasing the protective properties of the helmet. This is counter-intuitive and is an unexpected result. Common knowledge would tend to equate increased thickness of the cushioning layer proportionally providing additional impact resistance and absorptive affect. The present helmet cushioning system 10 provides a minimal thickness of absorptive material, but also significantly reduces the severity of an applied force on a user's head.

As is evident from the foregoing description, certain aspects of the present invention are not limited to the particular details of the examples illustrated herein. It is therefore contemplated that other modifications and applications using other similar or related features or techniques will occur to those skilled in the art. It is accordingly intended that all such modifications, variations, and other uses and applications which do not depart from the spirit and scope of the present invention are deemed to be covered by the present invention.

Other aspects, objects, and advantages of the present invention can be obtained from a study of the drawings, the disclosures, and the appended claims.

I claim:

1. An external cushioning system for a helmet comprising:

a first shell having an outer surface;

a second shell outward of said outer surface of said first shell;

an absorptive layer disposed between the outer surface of the first shell and the second shell;

an attachment mechanism to couple the second shell to the first shell; and at least one cushion strategically positioned at one of a forehead portion and a rear portion of the second shell to absorb impact forces.

2. The external cushioning system of claim 1, wherein the cushion is underneath said second shell.

3. The external cushioning system of claim 1 wherein the cushion is coupled to said second shell, said cushion comprises a cover and a thickness of absorptive material.

4. The external cushioning system of claim 1, wherein the cushion may be customizable to one of the level of play and the size of the player.

5. The external cushioning system of claim 1, wherein the second shell is one of rigid, semi-rigid, or flexible and the first shell is one of rigid, semi-rigid, or flexible.

6. The external cushioning system of claim 5 wherein said second shell is rigid and has a thickness which fractures upon application of a particular force, said particular force being a pre-determined threshold value at which a user is to be further evaluated.

7. The external cushioning system of claim 1, wherein the second shell outward of said first shell by an offset distance, said offset distance being less than around one-half inch.

8. The external cushioning system of claim 7, further comprising at least one cushion strategically positioned at one of a forehead portion and a rear portion of the second shell to absorb impact forces, said cushion comprises a cover and a thickness of absorptive material.

9. The external cushioning system of claim 1, wherein the second shell is fixed or removable relative to the helmet.

10. The external cushioning system of claim 1, wherein the first shell is flexible and the second shell is rigid.

11. The external cushioning system of claim 1, wherein said absorptive layer comprises a different thickness proximate a top of said second shell that at a side of said second shell.

12. The external cushioning system of claim 1, wherein said absorptive layer is micro-cellular urethane foam.

13. The external cushioning system of claim 1, wherein an outer layer of said helmet forms said first shell.

14. The external cushioning system of claim 1, further comprising a neck support extending downward from a bottom, rear portion of said external cushioning system.

15. The external cushioning system of claim 14, wherein said neck support extends from said absorptive layer.

16. The external cushioning system of claim 15, wherein said neck support further comprises a thicker support portion and a thinner connecting portion that connects said neck support with said external cushioning system.

17. The external cushioning system of claim 1, wherein said absorptive layer extends below a bottom rear edge of said first and second shells.

18. A helmet cushioning system comprising:

a first shell having an outer surface;

a second shell outward of said outer surface of said first shell, second shell being rigid and having a thickness which allows the second shell to fracture upon application of a particular force;

an absorptive layer disposed between the outer surface of the first shell and the second shell;

at least one cushion coupled to said second shell and strategically positioned at one of a forehead portion and a rear portion of the second shell to absorb impact forces, said cushion comprises a cover and a thickness of absorptive material; and an attachment mechanism to couple the second shell to the first shell.

19. The helmet of claim 18 wherein the second shell is outward of said first shell by an offset distance, said offset distance being less than around one-half inch.

20. The helmet of claim 18 wherein said particular force being a pre-determined threshold force at which a user is to be further evaluated.

21. The helmet of claim 18 wherein said particular force being less than a pre-determined threshold force at which a user is to be further evaluated.

22. The external cushioning system of claim 18, wherein an outer layer of said helmet forms said first shell.

23. The external cushioning system of claim 18, further comprising a neck support extending downward from a bottom, rear portion of said external cushioning system.

24. The external cushioning system of claim 23, wherein said neck support extends from said absorptive layer.

25. The external cushioning system of claim 23, wherein said neck support further comprises a thicker support portion and a thinner connecting portion that connects said neck support with said external cushioning system.

26. The external cushioning system of claim 18, wherein said absorptive layer extends below a bottom rear edge of said first and second shells.

27. An external cushioning system for a helmet comprising:

a first shell having an outer surface;

a second shell outward of said outer surface of said first shell;

an absorptive layer disposed between the outer surface of the first shell and the second shell;

an attachment mechanism to couple the second shell to the first shell; and wherein the second shell outward of said first shell by an offset distance, said offset distance being less than around one-half inch.

* * * * *